United States Patent [19]

Roth

[11] Patent Number: 4,641,441

[45] Date of Patent: Feb. 10, 1987

[54] FRAME RETAINING CLIP

[76] Inventor: Robert B. Roth, 519 E. 86th St., New York, N.Y. 10025

[21] Appl. No.: 582,561

[22] Filed: Feb. 21, 1984

[51] Int. Cl.[4] ..... A47G 1/06; G09F 1/12

[52] U.S. Cl. ..... 40/156; 40/152.1; 248/496

[58] Field of Search ..... 40/156, 152.1, 152; 248/496; 24/115 A; 16/108

[56] References Cited

U.S. PATENT DOCUMENTS

| | | | |
|---|---|---|---|
| 2,173,753 | 9/1939 | Copeland | 40/156 |
| 2,450,330 | 9/1948 | De Giers | 40/156 |
| 2,639,109 | 5/1953 | Hoag | 248/497 |
| 3,255,544 | 6/1966 | Bornholt | 40/156 |
| 3,996,682 | 12/1976 | Schwartz | 40/156 |
| 4,041,632 | 8/1977 | Sarkisian | 40/156 |
| 4,045,898 | 9/1977 | Reinhardt | 40/156 |
| 4,216,597 | 8/1980 | Kocina et al. | 40/156 |
| 4,235,030 | 11/1980 | Astolfi | 40/156 |

FOREIGN PATENT DOCUMENTS

| | | | |
|---|---|---|---|
| 2839974 | 3/1980 | Fed. Rep. of Germany | 40/156 |
| 1489842 | 10/1977 | United Kingdom | 40/156 |
| 2057870 | 4/1981 | United Kingdom | 40/156 |

*Primary Examiner*—Gene Mancene
*Assistant Examiner*—James Hakomaki

[57] ABSTRACT

A picture retaining clip for use at the corners and along the sides of a back-loading picture frame. The clip may also serve as a means for hanging the frame. The clip is a strip of resilient material with a central portion having two ends bent away from it. When the clip is mounted at the corners of the frame, slots at each end of the clip mesh with a ridge at the rear of the frame. When the clip is mounted along the side, top or bottom of the frame, slots formed adjacent the central portion of the clip and slots formed at the ends of the clip mesh with raised ridges along the inside of the frame. A hole or slot in the central portion of the clip may receive hooks, nails, or wire for hanging the frame.

6 Claims, 7 Drawing Figures

FRAME RETAINING CLIP

BACKGROUND OF THE INVENTION

This invention relates to back-loading picture frames. In particular, it relates to means for retaining pictures in back-loading frames and to means for hanging such frames.

Back-loading picture frames are so called because the glass, picture and mat are all placed in the frame from its rear. The forward portion of the frame is smaller than the rear and therefore the glass picture and mat are easily inserted into the rear of the frame. Tacks, brads and nails have been used in the past to secure pictures in frames. In addition, a number of clamps and clips which do not penetrate frames, have been developed for retaining pictures in back-loading frames.

Some devices used to retain pictures in back-loading frames are essentially clamps that grip the picture and the frame. Another form of retaining device is a compressed spring clip which does not grip the picture and the frame but rather is compressed between the rear of the frame and the picture. Such compressed spring clips are generally better protected from loosening by jarring because they are generally less exposed than gripping clamps. Some of these, however, are only useful at predetermined position either along the sides or corners of the frames.

Various means have been used for hanging picture frames such as holes, recesses or serrations in the clamps or clips for receiving nails, hooks or other devices, but they usually dictate that the clamps or clips be used in only one location on the frame.

Although compressed spring clips are a preferred means for retaining pictures in frames, it is often difficult to adapt them for use as hanging devices. When the compressed spring clips disclosed in the prior art are attached to back-loading frames, much of the clip structure is obscured from view even from the rear of the frame and access to them is severly hindered, thereby making it difficult to adapt them for receiving nails, hooks or wires. While U.S. Pat. No. 4,216,597 is an exception in that it provides for side or corner mounting and hanging it requires a flanged device which is not simple to manufacture.

It is an object of the present invention to provide an improved removable means for retaining pictures in back-loading frames.

Another object of the present invention is to provide an improved removable means for hanging a back-loading picture frame from a wall.

DETAILED DESCRIPTION OF THE PREFERRED EMBODIMENT OF THE INVENTION

Figure 3:
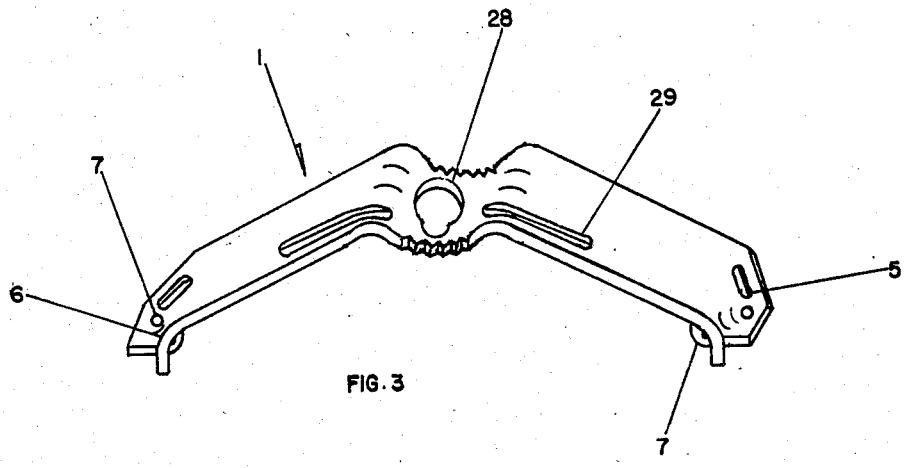
FIG. 3 is a perspective view of the preferred form of a clip shown in FIG. 1.
Figure 1:
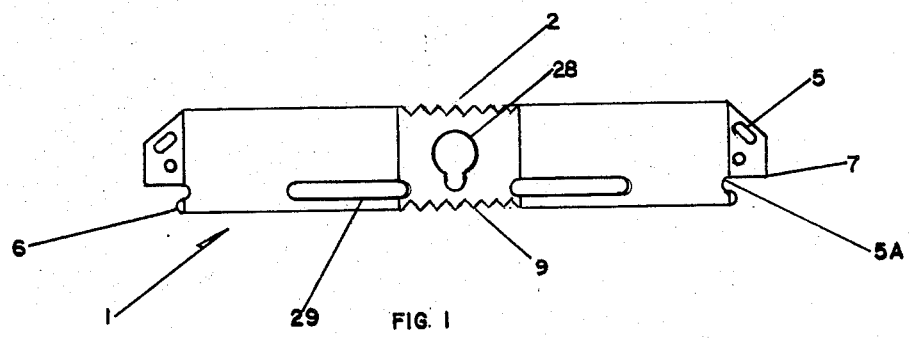
FIG. 1 is a top plan view of the preferred form of a clip according to the invention.
Figure 2:
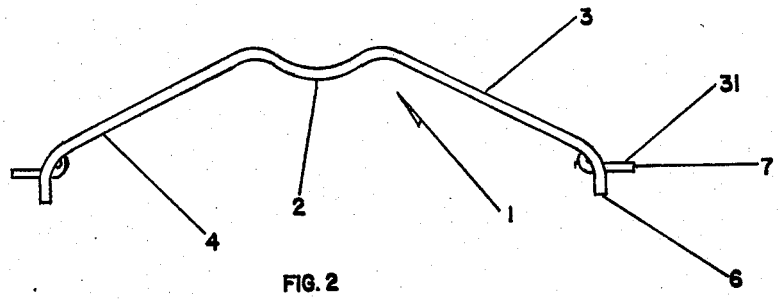
FIG. 2 is a side elevational view of the preferred form of a clip shown in FIG. 1.

FIGS. 1, 2 and 3 are the top plan, side elevational, and perspective views, respectively, of the preferred form of a clip. The clip 1 is made from a strip of resilient material preferably a strip of metal. The clip 1 can be fabricated by stamping or cutting blanks from strip stock and bending the blanks. The cutting operations mentioned below would in most instances be performed before or during the bending operation. The central portion 2 of the resilient strip is generally flat. Both ends 3 and 4 of the strip are deflected in the same direction away from the plane of the generally flat central portion 2.

This can most easily be done by simply bending each end of the flat strip of metal. The ends 3 and 4 proximate the central web 2 can satisfactorily be inclined at an angle usually above 30 degrees from the plane of the central web 2.

Each end of the strip has at least one slot 5 and one tab 6 forming an additional slot 5A. The tabs 6 and slots 5 are formed in the same position on both sides of the clip 1. Preferably, the tabs 6 are not pointed but have flat or round ends to avoid gouging of the frame end of the picture and injury to the user.

The clip 1 has a flange 7 formed along each edge of the clip 1. The flange extends out from the clip 1 in a direction opposite the direction of deflection of the ends 3 and 4. The flange 7 is formed on the same side as the slots 5.

The clip 1 include means for receiving hanger devices such as nails, hooks, and wire. One such means is a hole 28 centered in the central portion 2 of the clip 1. Another such means is one or more serrations 9 along the lateral edge of the central portion 2 and serrations 9 are shown in FIG. 1 only since they are optional.

Figure 4:
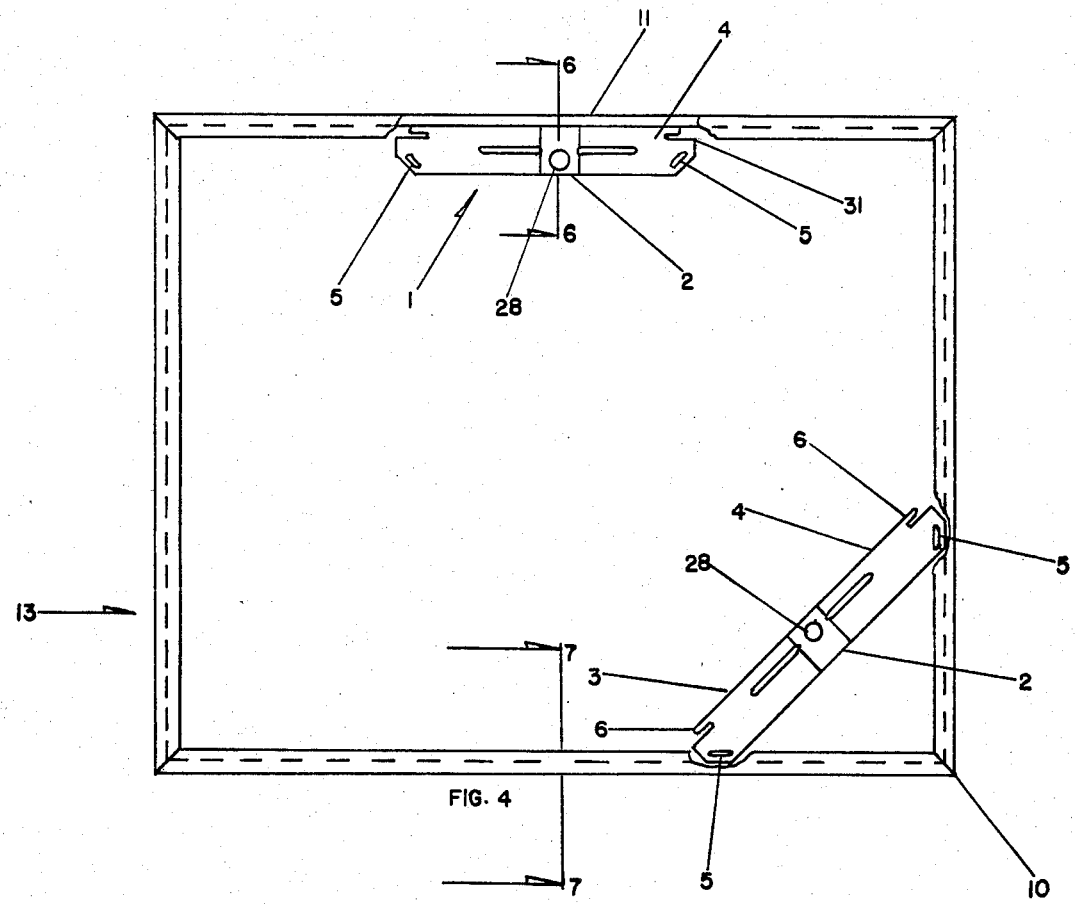
FIG. 4 is a rear view of a back-loading picture frame using clips according to the invention at the corners, top or sides.
Figure 5:
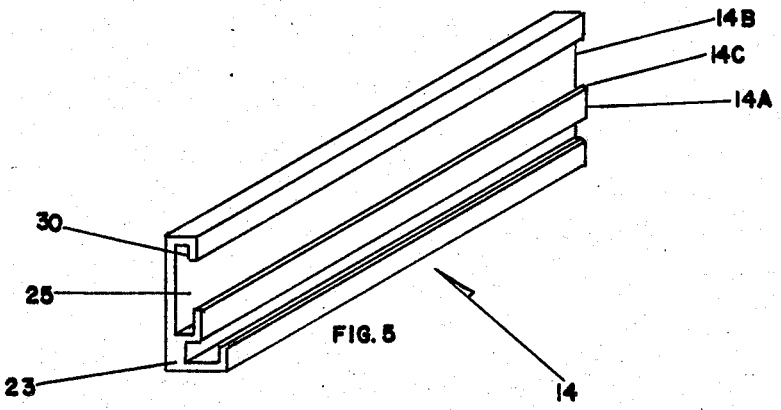
FIG. 5 is a perspective view of a frame section used to make a back-loading picture frame adapted for receiving a clip according to the invention.

FIG. 4 is a rear view of a back-loading frame 13 with the clips 1 mounted at the corner 10, and the top middle 11 of the frame 13 which is made from a plurality of frame sections 14. FIG. 5 is a perspective view of one frame section 14. The frame sections 14 may be made from a variety of materials, such as wood or plastic, but preferably they are metal such as extruded aluminum. The frame sections 14 are preferably of the same construction although their lengths might vary, but opposite sections would usually be of equal length. The frame sections 14 are fastened to each other at the corners 10 by means known in the art, such as by cooperating tongue and joint elements or adjoining sections or other mechnical connections such as welding and adhesives, or connecting elements such as clamps or staples.

Figure 6:
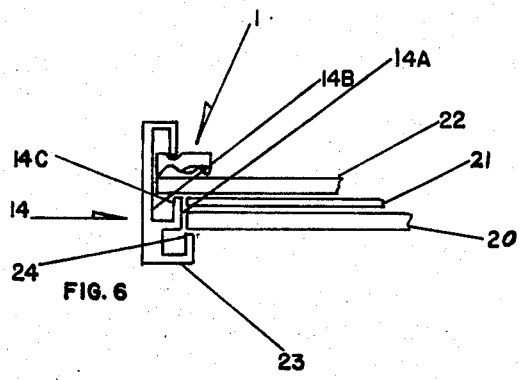
FIG. 6 is a cross-sectional view of the top of the frame taken along line 6—6.
Figure 7:
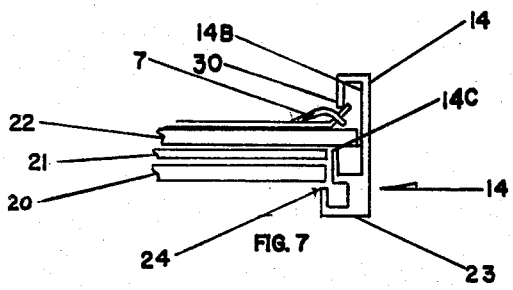
FIG. 7 is a cross-sectional view of the bottom of the frame taken along the line 7—7.

FIG. 7 is a cross sectional view taken along line 7—7 in FIG. 4 and illustrates how the clip 1 according to the invention is mounted at the corner 10 of a back loading picture frame 13. A glass plate 20, the picture 21, and a protective backing 22 such as cardboard sheet are inserted into the picture frame 13 from the rear. Optionally a picture mat may be placed between the picture 21 and the glass plate 20. It should be understood that the plate 20 and backing 22 may be dispensed with, and the picture 21 or other matter to be displayed may be inserted alone. The glass plate 20 abuts the front member 23 of each of the frame sections 14 along ridge 24 which serves to retain the plate 20 in the frame 13 by preventing it from coming out the front of the frame 13. The glass plate 20, picture 21, and backing 22 abuts each other with plate 20 abutting the rearwardly raised ridge 24 of the front member 23 of the frame section 14, this along with the plate 20, picture 21 and backing 22 abutting inside section 14A acts to center the picture 21 in the frame 13 in proper position for display. Backing 22 may optionally, as shown in FIGS. 6 and 7, abut the inside wall 14B and ridge 14C of frame section 14 depending on the thickness of plate 20 and picture 21. One or more of the retaining clips 1 are then inserted at the corners 10 from the rear of the frame to hold the plate 20, picture 21, and backing 22 in the frame 13. Preferably, a clip 1 is used in each corner 10 of the frame 13. In mounting a clip 1 at a corner 10, slot 5 on end 4 of the mounting clip 1 is inserted into the forwardly opening channel 25 in one section 14 so that it engages against the raised ridge 30 on the back member of that frame section 14. Clip 1 is then pushed down so that the central portion 2 and the other end 3 of the clip 1 and slot 5 on that end is similarly inserted into the forwardly opening channel 25 of the adjacent frame section 14 so that it engages against the raised ridge 30 on the rear member of that frame section 14. The plate 20, picture 21 and backing 22 are held in place in the frame 13 since they are pressed between the clip 1 and the forward member of each frame section 14. The ends 3 and 4 of the clip are long enough and deflected at such an angle so that some pressure is required to fit the clip 1 behind the picture 21 and against the frame 13. Thus, the picture 21 is resiliently held in the frame 13 by the clip 1. Because the clip 1 is made of resilient material it can be used to secure pictures 21 of varying thicknesses. The clip 1 may be released from the frame 13 by pressing down on one or both ends 3 and 4 of the clip 1 to disengage the slots 5 from the rear of the frame 13 and then sliding the clip 1 out.

When the clips 1 are used only at the corners 10 of the frame 13, the clips 1 need not have the slots 5A nor tab 6. However, the most versatile embodiment of the clip 1 has these features as well. Flange 7 is however, necessary because of the bending used to make flange 7, caused slot 5 to have depth so that it falls behind raised ridge 30 locking clip 1 in place.

FIG. 6 is a cross-sectional view taken along line 6—6 in FIG. 4 showing a clip 1 mounted along the sides or top of a back-loading frame 13. A plate 20, a picture 21, and a backing 22, are inserted into the frame 13. They are prevented from coming out the front of the frame 13 by the front member 23 of each frame section 14. They are centered in the frame 13 by inside surface **14*a* of each frame sections 14. The clip 1 is inserted along the side of the frame 13 and simultaneously pressed down and pushed sideways against the frame 13, so that the elongated slots 29 adjacent the central web 2 of clip 1 and slots 5A mesh with channel 25 and raised ridge 30 of frame section 14. The hole 28 of the central portion 2 of the clip 1 does not abut against the frame section 14; therefore, there remains access to hole 28 of the central portion 2 of the clip 1 from the rear of the frame for securing the frame 13 to a wall. The ends 3 of the clip 1 are long enough and deflected at such an angle so that some pressure is required to fit the clip 1 behind the picture 21 and against the frame 13. Thus, the picture 21 is resiliently held in the frame 13 by the clip 1. The clip 1 may be removed by reversing the insertion process, that is by pressing down on the clip 1 to disengage the elongated slots 29 and slots 5A and simultaneously pushing clip 1 sideways to remove it from the rear of the frame 13**.

Slots 5 on the ends 3 and 4 of the clip 1 are not required when the clip 1 is used only in the side mounted position on the rear of the frame 13 and they may be dispensed with. However, the clip 1 preferably has such slots 5 so that it may be used either at the corners 10 or along the sides.

A flange 7 is necessary so that when the clip 1 is inserted for side mounting, the flange 7 slides along the backing 22 when clip 1 is pressed flat and then when the pressure is released, the flange 7 slides back as the spring clip 1 returns to its original shape. At one end, on the flange 7, there is a sharp point or series of points 31 extending away from the flange 7, the points 31 catch on the backing 22 to prevent lateral sliding of the clip 1, when used as a hanger.

By using two clips 1 mounted on opposite sides of the picture frame 13, a wire not shown may be secured to the clips 1 by inserting the wire into the hole 28 and wrapping the loose ends of the wires. The wire is then used to hang the frame from a hook in the wall.

The clip 1 may also be used to hang the frame from a nail or hook mounted on the wall. The nail or hook may be inserted into the hole 28 in the clip 1. Preferably, instead of using a hole 28 in the clip 1, one or more serrations 9 on the central portion 2 of the clip 1 along one of its edges. FIG. 4 shows a clip 1 mounted at the top side of a back-loading frame 13 so that the serrations 9 engage the shank of a nail. The serrations 9 are accessible because that portion of the clip 1 is not obscured even when the clip 1 is mounted along the top side of the frame 13. The plurality of serrations 9 enables the frame 13 to be centered when hung so as to eliminate tilting.

The invention has been described with particular reference to the preferred embodiments, but it will be understood that variations and modifications within the spirit and scope of the invention may occur to those skilled in the art to which the invention pertains.

I claim:

1. An improved picture frame retaining clip comprising a resilient strip with a flat central portion and said flat central portion having a bent end on each side of the central portion, each bent end is bent away from the central portion in the same direction and to the same degree of bending and in addition each bent end is offset from the central portion with said offset in the opposit direction of the bend of each end.

2. The improved picture frame retaining clip of claim 1 wherein each bent end has one three sided slot and one four sided slot.

3. The improved picture frame retaining clip of claim 1 wherein the central portion and each bent end contains a four sided elongated slot that is partly in the central portion and partly in each bent end.

4. The improved picture frame retaining clip of claim 3 wherein the central portion also contains an opening for attaching the clip to a position securing device.

5. A resilient picture retaining clip used in conjunction with a back-loading picture frame, wherein a central portion of this clip has two ends bent away from the central portion, and each bent end is offset from the central portion with said offset in the opposit direction of the bend of each end, and when the clip is mounted in a corner of the frame, a slot at each bent end of the clip meshes with a raised ridge or the frame, the clip has in its central portion a means to receive a hanging means for the frame.

6. A resilient picture retaining clip used in conjunction with a back-loading picture frame, wherein a central portion of the clip has two ends bent away from the central portion, and each bent end is offset from the central portion with said offset in the opposit direction of the bend of each end, and when the clip is mounted at a side of the frame, a slot formed adjacent each side of the central portion of the clip as well as a slot formed at each end of the bent ends of the clip meshes with a raised ridge along the inside of the frame, the clip has in the central portion a means to receive a hanging means for the frame.

* * * * *